United States Patent [19]

Hammink et al.

[11] 4,133,570

[45] Jan. 9, 1979

[54] HOISTING APPARATUS HAVING IMPROVED CLAMPING MEANS

[75] Inventors: Willem C. Hammink, Woerden; Cornelis A. M. Verheul, Werkhoven, both of Netherlands

[73] Assignee: B. V. Nederlandse Kraanbouw Maatschappij NKM, Haarlem, Netherlands

[21] Appl. No.: 818,059

[22] Filed: Jul. 22, 1977

[51] Int. Cl.[2] ..... B66C 1/42

[52] U.S. Cl. ..... 294/110 R

[58] Field of Search ..... 294/62, 63 R, 67 BC, 294/106, 110 R

[56] References Cited

U.S. PATENT DOCUMENTS

| | | | |
|---|---|---|---|
| 1,510,176 | 9/1924 | Knight | 294/110 R |
| 1,673,237 | 6/1928 | Gerdes | 294/110 R |
| 2,215,844 | 9/1940 | Van Syckle | 294/110 R |
| 3,488,080 | 1/1970 | Hamilton | 294/110 R |
| 3,719,300 | 3/1973 | Siegmund | 294/62 X |
| 3,790,204 | 2/1974 | Lighthipe et al. | 294/110 R |

FOREIGN PATENT DOCUMENTS

| | | | |
|---|---|---|---|
| 439459 | 1/1975 | U.S.S.R. | 294/110 R |

*Primary Examiner*—Johnny D. Cherry

*Attorney, Agent, or Firm*—Snyder, Brown & Ramik

[57] ABSTRACT

A hoisting apparatus includes a hoisting shank slidably engaged with a yoke, the yoke having parallelogram linkages which carry a pair of gripping jaws. The shank is connected with the jaws to spread them apart as the shank moves downwardly with respect to the yoke, and is provided with locking mechanism normally connecting the shank directly to the yoke. A work-engaging mechanism automatically releases the locking mechanism and allows the shank to shift upwardly with respect to the yoke and cause the jaws to grip a load.

8 Claims, 4 Drawing Figures

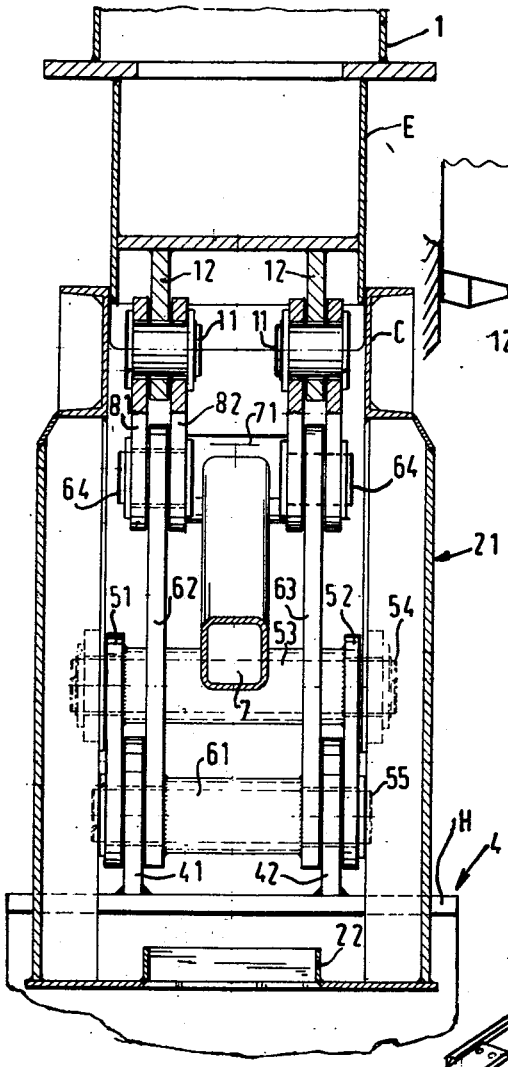
FIG. 3
FIG. 4
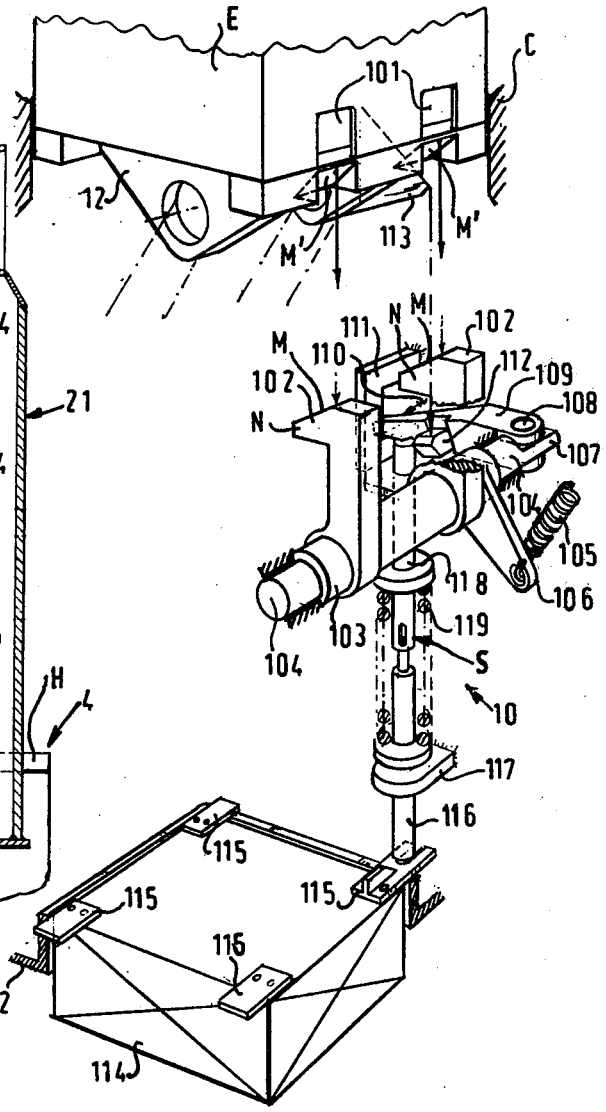

HOISTING APPARATUS HAVING IMPROVED CLAMPING MEANS

BACKGROUND OF THE INVENTION

This invention relates to hoisting apparatus having clamping jaws which have a short throw between open and clamping positions, and which thus have great utility in grappling and positioning loads where there is limited lateral clearance. As such, the present invention is related to U.S. Pat. No. 3,719,300. However, in contrast thereto, the present invention does not employ the weighted lever 14, 17 and the auxiliary lifting apparatus 12 of such patent to effect, respectively, the clamping action and the load-releasing action. Accordingly, the present invention can be of lesser weight than a comparable apparatus constructed according to U.S. Pat. No. 3,719,300. For example, in a commercial embodiment of the present invention, a weight reduction of about 300Kg is effected with respect to a comparable apparatus constructed according to U.S. Pat. No. 3,719,300.

BRIEF SUMMARY OF THE INVENTION

Basically, the present invention involves a horizontally elongate yoke provided with a clamping jaw at each end, with each clamping jaw being connected to the yoke by means of a parallelogram linkage. Centrally, the yoke guides the lower end of a vertical boom or post. The boom or post is vertically movable to effect raising and lowering of the yoke. The lower end of the post is provided with linkage means connected to the parallelogram linkage causing the jaws to grip the work or load in response to relative upward motion of the post with respect to the yoke. In its relatively lowered position with respect to the yoke, the post normally is locked to the yoke thereby holding the jaws in open, load-receiving position, and load-engageable means is provided which automatically releases the locking means when the jaws are properly positioned to grip the load.

BRIEF DESCRIPTION OF THE DRAWING FIGURES

FIG. 3 is a vertical section taken substantially along the plane of section line III—III in FIG. 2; and FIG. 4 is a perspective view illustrating the locking means and the release means therefor.

DETAILED DESCRIPTION OF THE INVENTION

Figure 1:
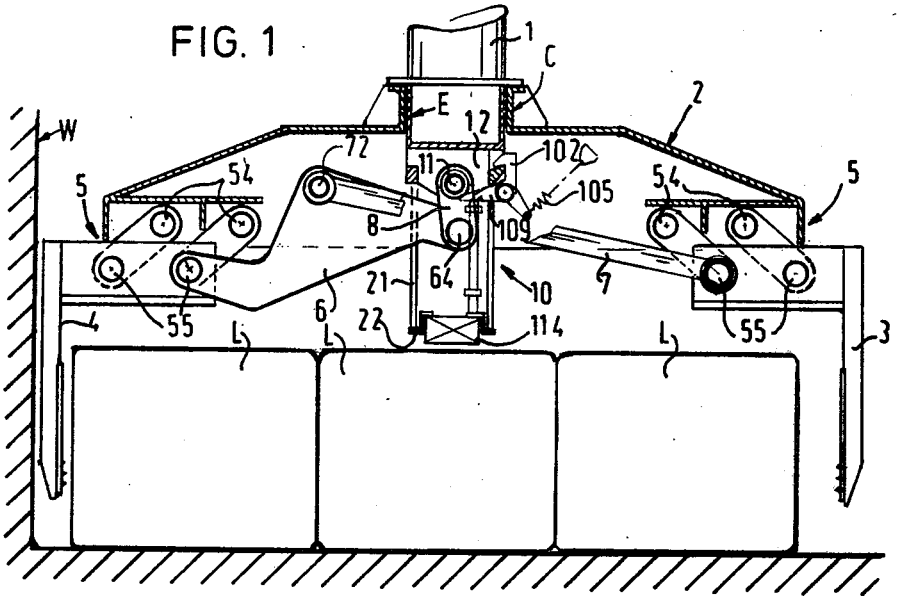
FIG. 1 is a side elevational view, partly in section, illustrating the hoisting apparatus in accordance with the present invention.

With reference at this time more particularly to FIG. 1, the reference character 2 indicates in general a yoke assembly which is provided centrally thereof with a collar C which normally receives and guides therewithin the lower end E of a shank or post 1 which is connected with suitable lifting means (not shown) for raising and lowering the load L which may, for example, be a plurality of anode blocks as used in an electric furnace for the production of aluminum.

The yoke 2 pivotally suspends a pair of clamping jaws 3 and 4 by means of the parallelogram linkages indicated generally by the reference characters 5 having pivotal connections at 54 to the yoke 2 and pivotal connections at 55 to the respective clamping jaws 3 and 4 substantially as is shown. The two parallelogram linkages 5 are operatively interconnected by means of a lever 6 and a coupling rod 7 so that the two parallelogram linkages operate in unison as will be presently apparent. The lever 6 is pivotally connected to one of the pivot pins 55 associated with the clamping jaw 4 and at its opposite end is pivotally attached as at 64 to the coupling linkage 8 which, at its upper end, is pivotally attached as at 11 to the lower extremity of the hoisting member 1. The coupling rod, on the other hand, is connected pivotally at one end through one of the pivot pins 55 of the clamping jaw 3 and at its opposite end is pivotally attached by the pivot pin 72 to an intermediate portion of the lever 6, substantially as is shown.

With reference to FIG. 3, it will be seen that the lower extremity of the hoisting assembly 1 is provided with dependent ears 12 which receive respective pivot pins 11 and that the linkage assembly 8 consists of two pairs of links 81, 82 straddling the respective dependent ears 12 and likewise straddling at their ends the two plate members 62 and 63 which together constitute the lever 6, the pivot pins 64 being received by the pairs of links 81, 82 substantially as is shown. The coupling rod, as shown, may be a tubular member having a cross head 71 at one end extending between the plates 62 and 63 and receiving therethrough the previously mentioned pivot pin 72 whereby to effect the pivotal connection of the rod 7 to the lever 6.

As will also be seen from FIG. 3, each link of the parallelogram linkages 5, 5 is formed by a pair of link members 51, 52 rigidly interconnected by a cross tube 53 and receiving therethrough the pivot pin 54 which also projects through opposite side wall portions of the yoke 2. The horizontal arm H of each jaw 3 or 4 is provided with a pair of upstanding ears 41, 42 for each pair of links 51, 52 and such ears carry the respective pivot pins 55. The connection between the lever 6, comprising the two plates 62 and 63 is effected as shown in FIG. 3, a tubular cross piece 61 being fixed between the free ends of these plates 62, 63 as shown and receiving the associated pivot pins 55.

FIG. 3 also illustrates that the yoke includes, integrally therewith, the depending support mechanism indicated generally by the reference character 21 which provides, at its lower extremity, the well 22 in vertical registry beneath the centrally located collar portion C, the purpose of which will be presently apparent.

Figure 2:
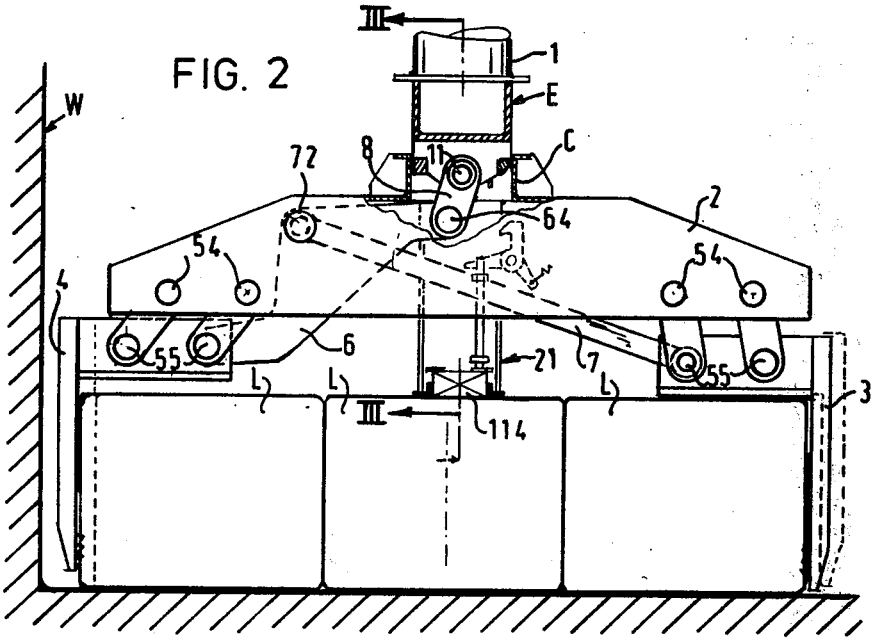
FIG. 2 is a view similar to FIG. 1 but showing the jaws in clamping engagement with the load.

As will be noted from FIG. 1, the lower extremity E of the hoisting mechanism or shaft 1 normally is nested within the collar C and a latching member 102 engages the lower extremity of the hoisting mechanism locking the same to the yoke, thereby maintaining the jaws 3 and 4 in the spread apart position shown in FIG. 1. By mechanism which will be described hereinafter, when the hoisting mechanism has been lowered with respect to the load L such that the jaws 3 and 4 may properly grip the same, the locking means 102 is released which allows the jaws 3 and 4 to grapple against and engage the load L while the hoisting mechanism 1, now released from the yoke 2 is displaced vertically upwardly as is illustrated in FIG. 2. As should be evident from FIGS. 1 and 2, the mechanism is particularly well suited to place the grappling assembly in close adjacency to a lateral obstruction such as the wall W as illustrated and properly to position the jaws 3 and 4 in proper position for grappling or engaging the load L. FIGS. 1 and 2 further illustrate the fact that the jaws 3 and 4 need not be perfectly aligned with the load in order to effect a proper gripping action thereon. For example, as is shown in FIG. 1, the jaw 4 is somewhat closer to the load than is the jaw 3 but when the locking means 102 is disengaged and the hoisting shaft 1 is moved upwardly, the linkage 8 draws the two jaws 3 and 4 firmly into engagement with the opposite sides of the load L, as shown in FIG. 2. At this point, it will be noted that the jaw 4 swings in only slightly from the position shown in FIG. 1 whereas the jaw 3 swings inwardly a much greater extent, see particularly FIG. 2. At this point, the parallelogram linkages 5, 5 are not symmetrically arranged but as soon as the load L is lifted from the supporting surface, the load supporting linkage 8 will tend to move to a vertical position, that is, with the pivot points 11 and 64 thereof vertically aligned to allow the parallelogram linkages 5, 5 to seek the proper positions.

The locking means and the release means is shown in greater particularity in FIG. 4 to which reference is now had. As illustrated, the lower end E of the hoisting assembly is provided with recesses 101 which are adapted to receive the noses N of the locking means 102. The locking means comprises these two members 102 which are rigidly affixed to a tubular member 103 pivotally supported on a pivot shaft 104 carried by the frame structure of the yoke assembly 2. The tube 103 is also provided with a radially projecting arm 106 to which the tension spring 105 is attached, the spring extending between the yoke 2 and the arm 106 normally to urge the members 102 in the direction to urge their noses N into the recesses 101 in the member E.

The load engaging member 114 is nested within the previously mentioned well 22 and it normally rests upon the upper edge thereof through the intermediary of the lugs 115. One of the lugs 115, as shown at the lower right of FIG. 4, is provided with a notch which receives the lower end of a rod 116 which is guided at its lower extremity in the ear 117 secured to the yoke 2 and which is coupled through a lost motion, pin and slot connection as indicated at S to the lower extremity of a second rod 118. The two rods 116 and 118 normally are urged apart to the extent that the lost motion connection S will permit through the intermediary of the compression spring 119 acting against the collars illustrated which are connected to the respective shafts 116 and 118.

The upper extremity of the shaft 118 is normally positioned below the free extremity of the release lever 109. The release lever 109 is pivotally attached by the pin 108 to the end portion 107 of the pivot shaft 104 and the free end portion thereof normally is urged into overlying relationship with respect to the upper end of the shaft 118 through the intermediary of the compression spring 110 acting between the yoke 2 and this lever 109.

The lever 109 is provided with a protruding cam member 112 which is adapted to engage the abutment portion 113 on the hoisting assembly whereby, as E is lowered in FIG. 4, the cam surfaces M, M of the nose portions N, N will engage against the corresponding cam surfaces M', M' of the member E to cock the levers 102 so as ultimately to permit their noses N to enter the recesses 101 under the action of the spring 105. At the same time, the cam 112 will engage the abutment 113 and swing the lever 109 to the right in FIG. 4 thus clearing the position in which it overlies the upper end of the shaft 118. As will be evident, the lowering of the hoisting mechanism 1 takes place when the load has been lowered onto a supporting surface and, for this reason, the load engaging member 114 will be raised upwardly within the well 22, thus necessitating the swinging aside of the lever 109 to disengage from the upper end of the shaft 118. Thus, irrespective of the fact that the shaft 118 is in the raised position, the noses N may engage in the recesses 101.

On the other hand, when the parts are locked together as previously described, and the hoisting mechanism is now lowered down onto a load, the load engaging member 114 will be settled within the well 22 thus bringing the upper end of the shaft 118 below the lever of the free end of the arm 109 as urged under the action of the compression spring 110 and the abutment member 111 will properly position the free end of the member 109 directly above the upper end of the shaft 118. Now, when the load engaging member 114 engages the load, the rod 116 and consequently the rod 118 will be shifted upwardly thereby to pivot the locking assembly 102, 103 and withdraw the noses N from within the recesses 101. Now, when the lifting shaft 1 is again raised, the noses N will be out of engagement with the recesses 101 and will clear same before the cam 112 strikes the abutment 113 which thereby releases the levers 102 to swing back, under the action of the spring 105 to their normal position.

What is claimed is:

1. A hoisting apparatus comprising, in combination:

a horizontally elongate yoke having a clamping jaw located at each end thereof, and parallelogram linkage means suspending each clamping jaw from its associated end of the yoke for allowing said clamping jaws to move toward and away from each other respectively to grip and release a load;

a hoisting member slidably received in said yoke between said ends thereof;

linkage means joining each clamping jaw to said hoisting member for supporting said yoke from said hoisting member while urging said jaws together, said linkage means including a lever pivotally connected at one end thereof with one of said clamping jaws, a coupling rod pivotally connected at one end thereof with the other of said clamping jaws and pivotally connected at its opposite end to said lever, and load suspension linkage means pivotally depending from said hoisting member and pivotally connected to said lever; and lock means for automatically connecting said yoke directly to said hoisting member when said clamping jaws are spread apart in load-releasing position.

2. A hoisting apparatus as defined in claim 1 wherein said lock means includes a load-actuated release mechanism.

3. A hoisting apparatus comprising, in combination:

a horizontally elongate yoke having a clamping jaw located at each end thereof, and parallelogram linkage means suspending each clamping jaw from its associated end of the yoke for allowing said clamping jaws to move toward and away from each other respectively to grip and release a load;

a hoisting member slidably received in said yoke between said ends thereof;

linkage means joining each clamping jaw to said hoisting member for supporting said yoke from said hoisting member while urging said jaws together;

lock means for automatically connecting said yoke directly to said hoisting member when said clamping jaws are spread apart in load-releasing position; said lock means including a load-actuated release mechanism; and said lock means comprising a spring-biased hook carried by said yoke and engageable with said hoisting member, said release mechanism including an arm pivotally connected with said hook, a compressible link normally underlying said arm and adapted to act upon said arm to disengage said hook from said hoisting member when the hoisting apparatus engages a load, and cam means on said arm for swinging said arm aside and out of the path of said compressible link in response to downward motion of said hoisting mechanism with respect to said yoke.

4. A hoisting apparatus as defined in claim 3 wherein said release mechanism also includes a load-engaging member vertically guided in said yoke and underlying said compressible link, said load-engaging member having a lowermost position allowing the upper end of said compressible link to clear said arm, and spring means normally urging said arm into overlying relation to said upper end of the compressible link whereby the release mechanism is operative only when said hook is engaged with said hoisting member and said load-engaging member subsequently is allowed to move to its lowermost position.

5. A hoisting apparatus comprising, in combination:

a vertical hoisting shank;

a horizontally elongate yoke slidably received on the lower end of said shank;

a pair of clamping jaws, one located beneath each end of said yoke, and a pair of parallelogram linkage means, one pivotally suspending each clamping jaw from said yoke, for allowing said jaws to move horizontally toward and away from each other;

linkage means connecting said hoisting shank with said clamping jaws for causing said jaws to spread apart in response to downward movement of said shank relative to said yoke and for causing said jaws to move toward each other to clamp work therebetween in response to upward movement of said shank relative to said yoke;

locking means for locking said shank to said yoke when said jaws are spread apart;

work-engaging means for automatically releasing said locking means when said jaws have been lowered into work-straddling position; and said linkage means comprising a lever pivotally connecting at one end to one of said parallelogram linkage means, a coupling member pivotally connected at its opposite ends respectively to the other of said parallelogram linkage means and to said lever, and suspension link means pivotally depending from the lower end of said shank and pivotally connected to said lever.

6. A hoisting apparatus as defined in claim 5 wherein said work-engaging means comprises a work-engaging member slidably carried by said yoke between said jaws and mechanism extending between said work-engaging member and said locking means to release the latter upon relative upward movement of said work-engaging member.

7. A hoisting apparatus comprising, in combination:

a horizontally elongate yoke having a clamping jaw located at each end thereof, and parallelogram linkage means suspending each clamping jaw from its associated end of the yoke for allowing said clamping jaws to move toward and away from each other respectively to grip and release a load;

a hoisting member slidably received in said yoke between said ends thereof;

linkage means joining each clamping jaw to said hoisting member for supporting said yoke from said hoisting member while urging said jaws together;

lock means for automatically connecting said yoke directly to said hoisting member when said clamping jaws are spread apart in load-releasing position;

said lock means comprising a spring-biased hook carried by said yoke and engageable with said hoisting member, said release mechanism including an arm pivotally connected with said hook, a compressible link normally underlying said arm and adapted to act upon said arm to disengage said hook from said hoisting member when the hoisting apparatus engages a load, and cam means on said arm for swinging said arm aside and out of the path of said compressible link in response to downward motion of said hoisting mechanism with respect to said yoke.

8. A hoisting apparatus as defined in claim 7 wherein said release mechanism also includes a load-engaging member vertically guided in said yoke and underlying said compressible link, said load-engaging member having a lowermost position allowing the upper end of said compressible link to clear said arm, and spring means normally urging said arm into overlying relation to said upper end of the compressible link whereby the release mechanism is operative only when said hook is engaged with said hoisting member and said load-engaging member subsequently is allowed to move to its lowermost position.

* * * * *